US006211766B1

(12) United States Patent
Goseberg et al.

(10) Patent No.: US 6,211,766 B1
(45) **Date of Patent: *Apr. 3, 2001**

(54) HIGH VOLTAGE TRANSFORMER

(75) Inventors: Walter Goseberg, Neuenrade (DE); Daniel Goudey, Gray (FR); Michel Malfroy, Vantoux (FR); Samuel Nguefeu, Antony (FR)

(73) Assignee: Thomson Television Components France, Boulogne Billancourt (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/407,137

(22) Filed: Sep. 27, 1999

(30) Foreign Application Priority Data

Sep. 30, 1998 (FR) ..... 98 12251

(51) Int. Cl.[7] ..... H01F 27/30

(52) U.S. Cl. ..... 336/198; 336/68; 336/185; 336/208

(58) Field of Search ..... 336/198, 185, 336/208, 206, 180; 363/65, 68, 336

(56) References Cited

U.S. PATENT DOCUMENTS 4,091,349 * 5/1978 Niederjohn et al. ..... 336/192
4,266,269 * 5/1981 Toba ..... 363/68
4,569,010 * 2/1986 Klokkers et al. ..... 363/68
4,660,139 * 4/1987 Nellen et al. ..... 363/68
5,576,681 * 11/1996 Sander et al. ..... 336/208

FOREIGN PATENT DOCUMENTS 0082966 7/1983 (EP) .
0529418 3/1993 (EP) .
9210906 6/1992 (WO) .

OTHER PUBLICATIONS

Search Report for French Patent Appln. No. 9812251 No Date.

* cited by examiner

*Primary Examiner*—Lincoln Donovan
*Assistant Examiner*—Tuyen T. Nguyen
(74) *Attorney, Agent, or Firm*—Joseph S. Tripoli; Joseph J. Laks; Joseph J. Kolodka

(57) ABSTRACT

A step-up coil of a high-voltage transformer for powering a cathode-ray tube comprises windings housed in chambers of a coil former. These windings are made in pairs. The inner end of the first winding of the pair is connected to an electrode of a first diode, the inner end of the second winding of the pair is connected to the electrode of like nature of the second diode, or alternatively, the outer end of the first winding of the pair is connected to an electrode of the first diode, the outer end of the second winding of the pair being connected to the electrode of like nature of the second diode.

The inter-winding capacitances of the windings of the pair are thus non-activated, the corollary of this being a decrease in the value of stray oscillations of the output voltages.

16 Claims, 6 Drawing Sheets

HIGH VOLTAGE TRANSFORMER

BACKGROUND OF THE INVENTION

1. Field of the Invention

The invention lies in the field of chambered high-voltage transformers intended for powering high-voltage electrodes of cathode-ray tubes, such as those used in television receivers or monitors. It relates more particularly to a step-up coil of such a transformer, and the transformer equipped with this coil.

2. Description of the Prior Art

From the technological standpoint, high-voltage transformers may be divided into two major families, chambered transformers and layered transformers. The transformers of these two families comprise a ferromagnetic circuit and primary and secondary windings coiled around at least part of the magnetic circuit. The secondary windings comprise two types of windings, secondary windings which serve to produce auxiliary voltages of for example 5, 12 or 30 volts and windings serving to produce the high voltages required for the operation of the cathode-ray tube, for example the focusing voltage of the order of 7 to 10 kilovolts and the anode voltage of the order of 30 kilovolts. These latter windings are commonly referred to as tertiary windings or else step-up windings. In layered transformers, the step-up windings are mounted around part of the magnetic circuit, in concentric coaxial layers situated one above another in a radial direction with respect to the axis of the magnetic circuit. The various layers of windings are galvanically insulated from one another by layers of a flexible insulating material installed before winding the following layer. In chambered transformers, the step-up windings are galvanically insulated from one another through the fact that they are housed respectively in chambers separated by insulating partitions. These chambers are distributed along an axial line of the magnetic circuit. The transformer according to the invention lies in this latter category, that of chambered transformers. These transformers are already widely known and have been described in the prior art.

Chambered transformers have an advantage over layered technology in so far as the cost of construction is lower, in particular because it is possible to simultaneously coil the windings of several chambers. Moreover, the interruptions required for laying an insulant, for example of the terphane type, between layers are avoided. On the other hand, they exhibit greater so-called "ringing" stray voltages. These oscillations produce perturbations to the image on the screens of cathode-ray tubes. These perturbations of the image are unacceptable on top-range television sets, monitors or televisions with a high definition image. It has been noted that these image perturbations were nonexistent or at least much reduced with layer-technology transformers. The inventors think that this difference stems from what they refer to as inactivation of the inter-layer capacitances. The various inter-layer capacitances is energized at each of their two ends by identical voltage pulses. The alternating variation in voltage across the terminals of these capacitances is therefore zero. The inter-layer stray capacitances not excited. Moreover, these layer-technology transformers benefit from the perfect coupling between the primary winding and each layer of the step-up winding. Moreover, the insertion between the earth and the first section of the step-up coil (first layer) of a dipole consisting of a resistor in parallel with an inductor helps to expunge any residual overoscillation almost completely. The inventors think that for these reasons a voltage devoid of ringing and capable after rectification of delivering a very stable DC level when the screen scanning frequency or the luminance of the image, which determines the beam current, varies is obtained at the end of any intermediate layer chosen to deliver, for example, the focusing voltage. Tracking of focusing is then said to be good. In the chambered technology, the inter-chamber capacitances are activated on account of the fact that the instantaneous voltages present on the windings of two consecutive chambers are different. This results in the generation of stray voltages due to the chargings and dischargings of these capacitances.

SUMMARY OF THE INVENTION

According to the invention it is proposed to construct the windings of each chamber and the connections of the ends of the wires making up these windings in such a way that at least one of the inter-chamber capacitances is not activated.

To this end, the invention relates to a step-up coil of a transformer, the coil comprising a coil former made of an insulating material, the former comprising chambers along an axial line of the former, these chambers, delimited by radial partitions housing voltage step-up wire windings including a first winding, a last winding, and intermediate windings, each of these windings having two ends, an inner end and an outer end, each end of a winding being, with the exception of one of the ends of the first winding and of one of the ends of the last winding, connected to an end of a following or preceding winding or to an electrode of a step-up diode having two electrodes, an anode and a cathode, which coil is characterized in that it comprises at least one pair of windings consisting of two windings, a first winding of the pair and a second winding of the pair, housed in two consecutive chambers, at least two diodes, a first and a second, the inner end of the first winding of the pair being connected to an electrode of the first diode, the inner end of the second winding of the pair being connected to the electrode of the second diode, B1 or alternatively, the outer end of the first winding of the pair being connected to an electrode of the first diode, the outer end of the second winding of the pair being connected to the electrode of the second diode B1.

In the commonest embodiment, the coil comprises at least two pairs of windings, a first and a second, made up as indicated above, the four windings constituting the two pairs being housed in consecutive chambers, the two pairs together making up an elementary cell, the inner end of the first winding of the first pair being connected to an electrode of the first diode, the inner end of the second winding of the first pair being connected to the electrode of like nature of the second diode, and the outer end of the first winding of the second pair being connected to the other electrode of the first diode, the outer end of the second winding of the second pair being connected to the other electrode of the second diode.

BRIEF DESCRIPTION OF THE DRAWINGS

The invention will be better understood by reading the description of an exemplary embodiment and of variants which will be given hereinbelow in conjunction with the appended drawings in which.

DETAILED DESCRIPTION OF THE INVENTION

Figure 1:
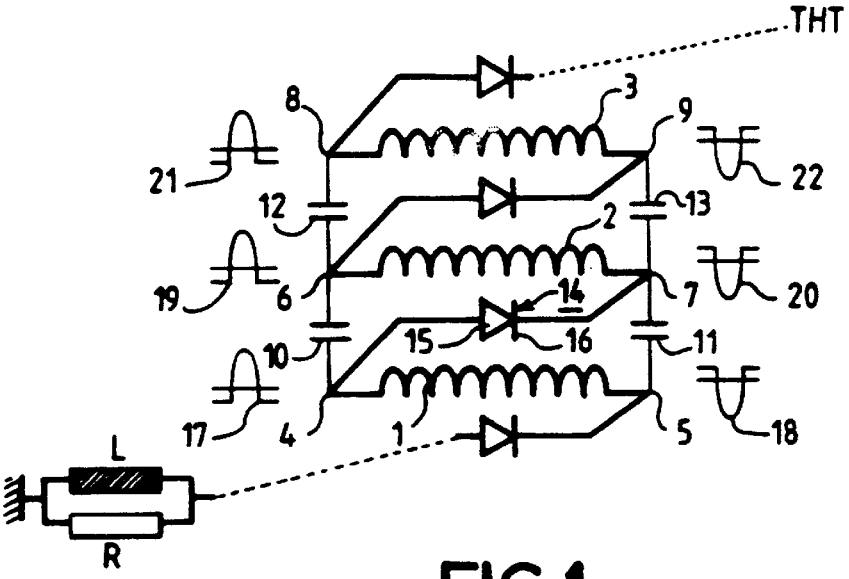
FIG. 1 represents layers of a layered voltage raiser as well as the inter-layer capacitors.
Figure 2:
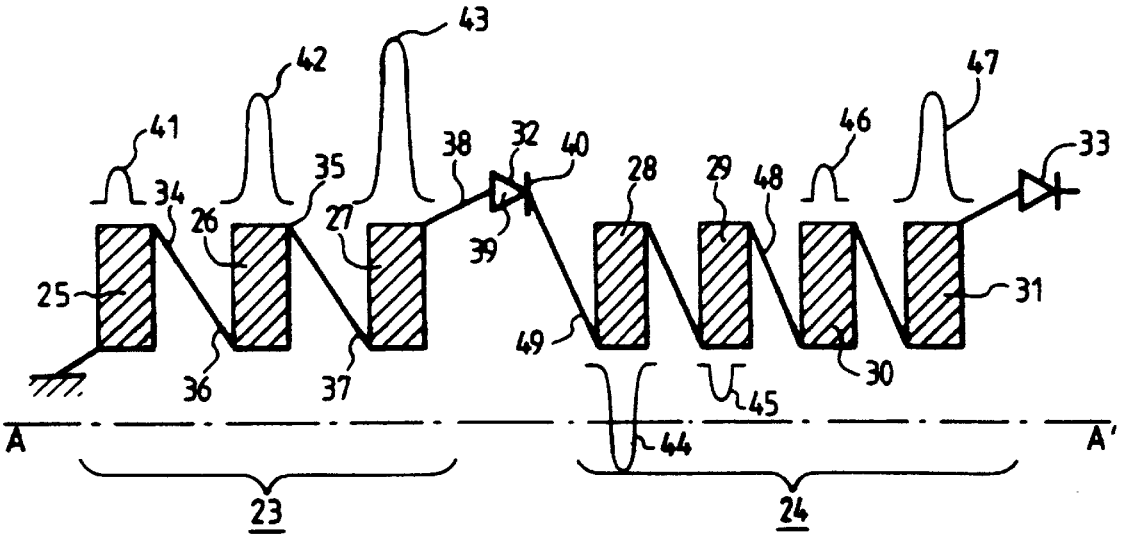
PRIOR ART FIG.2
FIG. 2 diagrammatically represents an example of windings of consecutive chambers as well as a diode separating two consecutive step-up windings such as constructed according to the prior art.

FIGS. 1 and 2 are intended to elucidate the technical problem solved by the inventors. FIG. 1 represents layers 1, 2, 3 of a layered voltage raiser. Each layer is made up of a winding having a first and a second end, 4, 5 for layer 1; 6, 7 for layer 2; and 8, 9 for layer 3. The inter-layer capacitances between the layers 1 and 2, 2 and 3 are made up physically by the opposing wire surfaces of each of the layers. Such capacitances are said to be physically distributed. In FIG. 1, they are located, for the convenience of the drawing, at the ends of each winding. To portray these capacitances, they have been represented, for example for the capacitance distributed between layers 1 and 2, by capacitors 10, 11, located between the first ends 4, 6 and the second ends 5, 7 of the layers 1 and 2 respectively. A capacitor 12 and a capacitor 13 represented connected in the same manner represents the inter-layer capacitance between the layers 2 and 3. Each first end is coupled to the second end of the following layer by a diode. Thus, the first end 4 of the winding 1 making up the first layer is connected to an anode 15 of a diode 14 whose cathode 16 is connected to the second end 7 of the winding 2 making up the second layer. The voltage pulses 17, 19, 21 present at the first ends 4, 6, 8 respectively, and the voltage pulses 18, 20, 22 present at the second ends 5, 7, 9 respectively, have been represented in FIG. 1. According to the inventors, the inter-layer capacitances are not activated because the voltage signals present at the first, 4, 6, 8 and second 5, 7, 9 ends respectively are of similar shape, like amplitude and like sign. Therefore there are no chargings and dischargings of these capacitances introducing poorly controlled voltages.

FIG. 2 represents the pulses present at chambers of a chambered raiser coiled in a known manner. The outer end is the end located at the termination of the winding, the wire vicinity of this end constitutes the turns which are radially furthest away from the axis of the winding coil. This expression is in contrast to inner end, that is to say the one located at the bottom of the chamber in proximity to the winding mandrel, the wire vicinity of this end makes up the turns which are radially closest to the axis of the winding coil. The winding mandrel is not represented in FIG. 2. Only the axis AA' of this mandrel has been represented. The figure represents two consecutive step-up winding sections, a first 23 and a second 24. The first section 23 comprises three partial windings 25, 26, 27. Each of these windings is housed in a chamber (not represented). The second section comprises four partial windings 28, 29, 30, 31. Each of these windings is housed in a chamber (not represented). The two sections 23, 24 are connected by way of a diode 32. The second section 24 is connected to a diode 33 providing the link with a following section (not represented). The outer ends 34 and 35 of the partial windings 25, 26 respectively are connected to the inner ends 36, 37 respectively of the partial windings 26, 27 respectively. The outer end 38 of the last partial winding of the first section 23 is connected to the anode 39 of the diode 32, the cathode 40 of this diode is connected to the inside end 49 of the first partial winding 28 of the second section 24. For convenience of explanation, it is assumed that each of the partial windings 25–31 contains the same number of turns. The signals 41–43 measured by the inventors at the outer end of each of the windings 25–27 respectively of the first cell 23 are represented in FIG. 2, alongside these windings. These signals are of substantially like shape but different amplitude. This results in potential differences at the inter-winding capacitances. The inter-winding capacitances are activated. "Ringing" stray signals result therefrom. The signals 44, 45 measured by the inventors at the inner end of each of the windings 28–29 respectively of the second cell 24 are represented in FIG. 2, alongside these windings. Likewise, the signals 46–47 measured by the inventors at the outer end of each of the windings 30, 31 respectively of the second cell 24 are represented in FIG. 2, alongside these windings. At the cell 24, owing to the presence of the diode 32, the signal 44 is of opposite sign to those of the signals 41–43. At the point 48, situated at the point of symmetry of the windings of the cell 24, the alternating component of the potential is zero. The signals 46, 47 measured by the inventors at the outer end of each of the windings 30, 31 respectively are positive, of like shape but different amplitude. As in the case of the cell 23, this results in potential differences at the inter-winding capacitances. The inter-winding capacitances are activated. Since the presence of the inter-winding capacitances results from the very existence of these windings which are necessarily close to one another for reasons of minimum bulk, it is not possible to do away with them, rather the inventors have found a means of not activating some of them. This is the means which will be explained hereinbelow in conjunction with FIG. 3.

Figure 3:
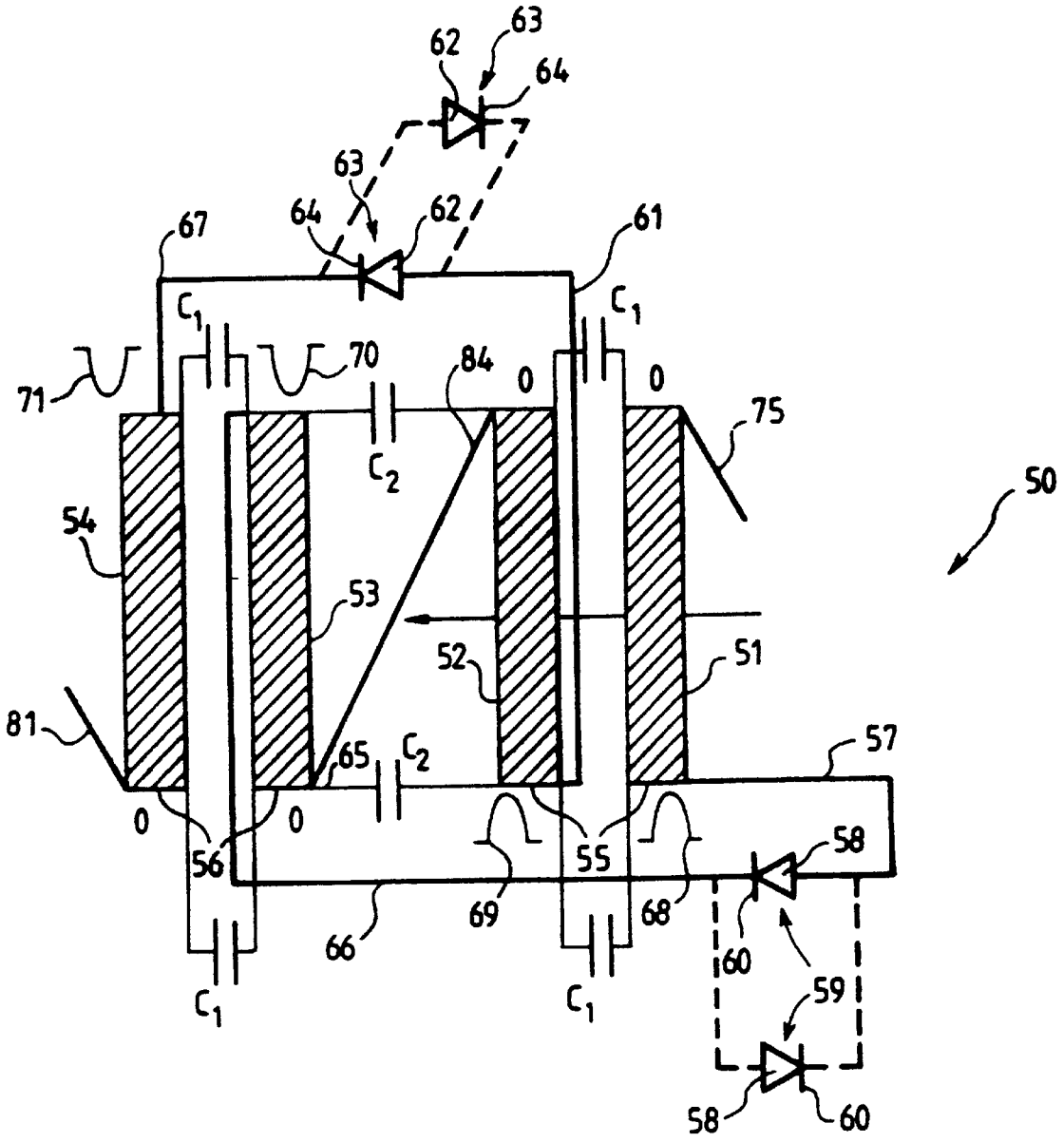
FIG. 3 diagrammatically represents, according to the invention, an elementary cell comprising the windings of four consecutive chambers as well as the connections of these windings to diodes separating the windings.

FIG. 3 represents what the inventors have referred to as an elementary cell 50 of a step-up winding. This cell 50 comprises four consecutive windings 51–54 distributed into two pairs 55, 56. When windings are said to be consecutive, what is meant is that these windings are distributed in axially consecutive chambers. The inner end 57 of the first winding 51 of the first pair 55 is connected to the anode 58 of a first diode 59. The inner end 61 of the second winding 52 of the first pair 55 is connected to the anode 62 of a second diode 63. The outer end 84 of the second winding 52 of the first pair 55 is connected to the inner end 65 of the first winding 53 of the second pair 56 of the elementary cell 50. The outer end 66 of this first winding 53 of the second pair 56 of the elementary cell 50 is connected to the cathode 60 of the first diode 59. Lastly, the outer end 67 of the second winding 54 of the second pair 56 of the elementary cell 50 is connected to the cathode 64 of the second diode 63. It may thus be seen that the inner end 57, 61 of the first and second windings 51, 52 of the first pair of consecutive windings 55 is connected to the anode 58, 62 of the diodes 59, 63 respectively. As a result, the signals present at these ends 57, 61 are of like shape, of like magnitude and of like sign. These signals are referenced 68 and 69 respectively. In this way the inter-winding capacitances $C_1$ between the windings 51, 52 making up the first pair are not activated.

The outer end 66, 67 of the first and second windings 53, 54 of the second pair 56 of the elementary cell 50 is connected to the cathode 60, 64 of the diodes 59, 63 respectively. As a result, the signals present at these ends 66, 67 are of like shape, of like magnitude and of like sign. These signals are represented at 70 and 71 respectively. In this way the inter-winding capacitances $C_1$ between the windings 53, 54 making up the second pair are not activated.

It may be noted in FIG. 3 that the windings 51, 52 or 53, 54 of each pair have between them a distance smaller than the distance separating the two pairs 55, 56 from one another. This is due to the fact that the inter-winding capacitances $C_1$ between two windings of the same pair are inactivated. The value of these capacitances may be relatively high. On the other hand, the capacitances $C_2$ between the opposing faces of windings not belonging to the same pair are activated since the signals 0 and 69, or 70 and 0 present at their ends are different. There is therefore benefit in reducing the value of these capacitances $C_2$. This is the purpose of the larger distance observed between the windings of two consecutive pairs. In the preferred embodiment of the invention, which will be described hereinbelow in conjunction with FIGS. 5 and 6, the insulating partitions separating the windings of the same pair are thicker than each of the outer partitions of the pair. On the other hand, each pair is separated from the following by a separating groove. Hence, separation between the windings 52, 53, which are closest together, of two pairs of a cell is catered for by the thickness of two partitions of chambers containing windings and by the axial length of the separating groove.

In the elementary cell just described, the inner ends of the windings 51, 52 are each connected to a diode anode. Likewise, the outer ends of the windings 53, 54 making up the second pair are each connected to a cathode. It should be noted that from the point of view of the inactivation of the inter-winding capacitances, the equivalent is achieved if the inner ends of the windings 51, 52 are each connected to a diode cathode, and the outer ends of the windings 53, 54 making up the second pair are each connected to an anode. To describe this first variant of the invention it is sufficient to repeat the description just given, while replacing "cathode 60, 64" with "anode 58, 62" respectively. The electrical diagram of this first variant is obtained from the diagram of FIG. 3 by reversing the position of the diodes as represented by a dotted line in FIG. 3.

Figure 4:
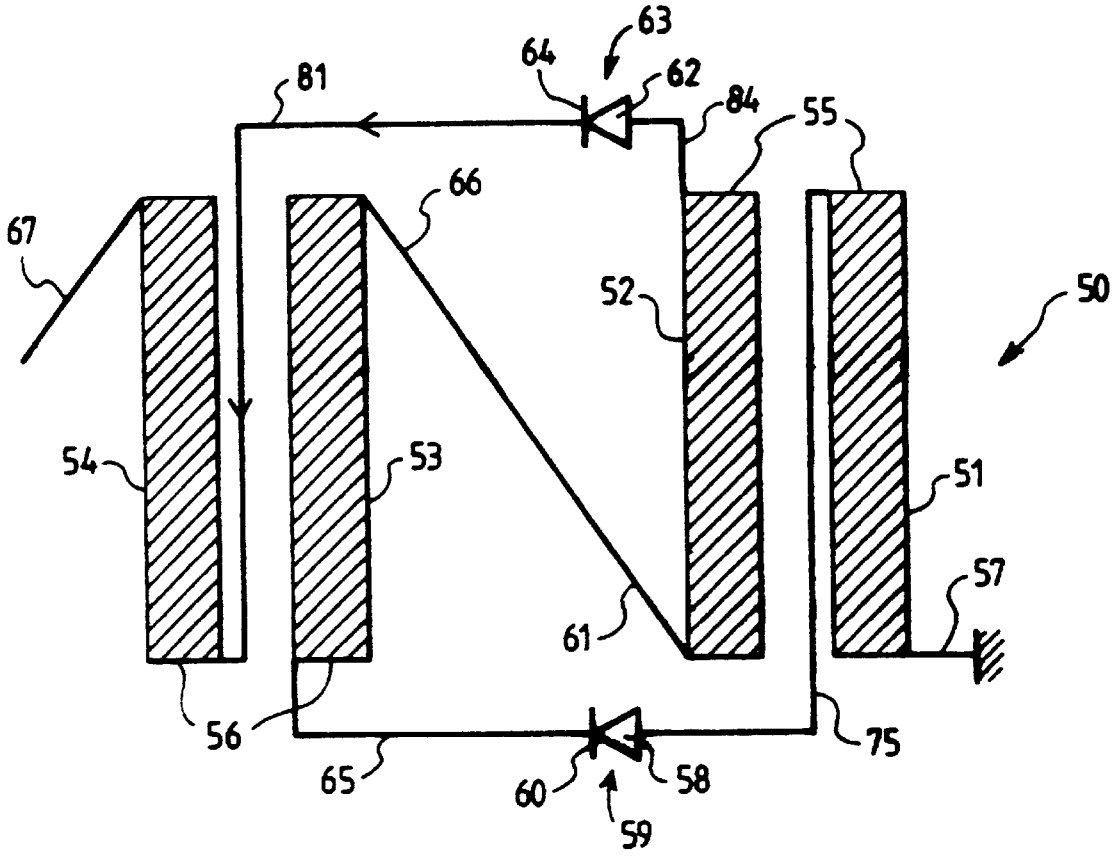
FIG. 4 diagrammatically represents, according to a variant embodiment of the invention, an elementary cell comprising the windings of four consecutive chambers as well as the connections of these windings to diodes separating the windings.

Another equivalent mode of inactivation is represented in FIG. 4. In this mode, instead of connecting the inner ends of each one of the windings of the first pair to an anode of a diode, the outer ends are so connected. The inner end 61 of the second winding 52 of the first pair 55 is connected to the upper end 66 of the first winding 53 of the second pair 56. The lower ends 65, 81 of the first and second windings of the second pair 56 are connected to the cathodes 60, 64 of the diodes 58, 63 respectively. It should be noted that the positions of the diodes may be reversed as explained above in conjunction with FIG. 3.

A step-up coil constructed in accordance with the invention generally comprises several elementary cells 50. In the embodiment represented in FIG. 3, the outer end 75 of the first winding 51 of the first pair 55 is connected to the inner end of the second winding of the second pair of a preceding cell or in the case of the first cell is coupled in a known manner to a source at reference potential. The inner end 81 of the second winding 54 of the second pair 55 is connected to the outer end of the first winding of the following cell or in the case of the last cell is coupled to the high-voltage output of the transformer either directly or by way of windings and/or diodes.

In the embodiment represented in FIG. 4, the inner end 57 of the first winding 51 of the first pair 55 is connected to the outer end of the second winding of the second pair of a preceding cell or in the case of the first cell is coupled in a known manner to a source at reference potential. The outer end 67 of the second winding 54 of the second pair 55 is connected to the inner end of the first winding of the following cell or in the case of the last cell is coupled to the high-voltage output of the transformer either directly or by way of windings and/or diodes.

Regardless of the embodiment, the inactivation of the inter-winding capacitances contributes to the decrease in the "ringing".

Figure 5:
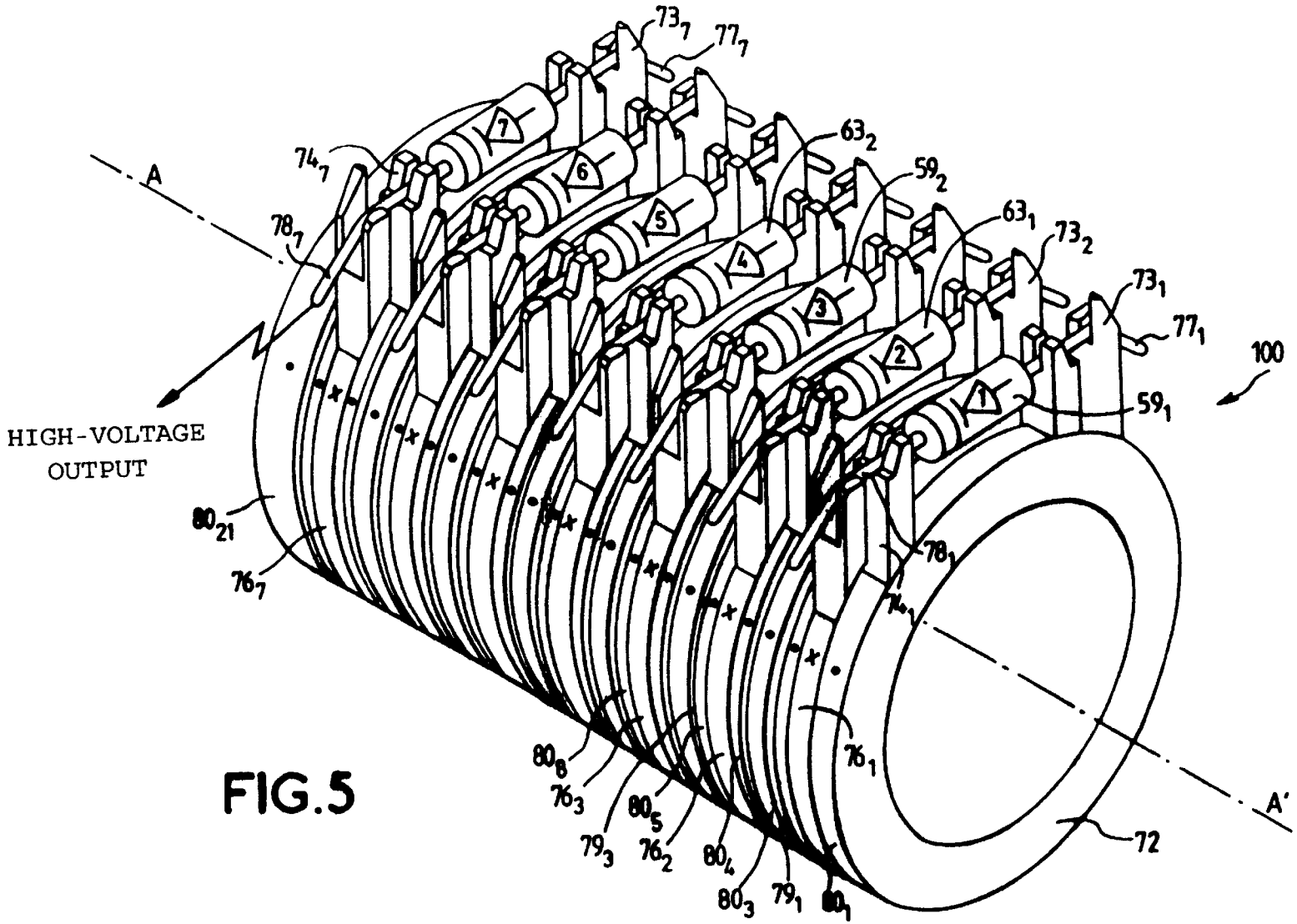
FIG. 5 is a perspective view of a coil constructed according to the invention.
Figure 6:
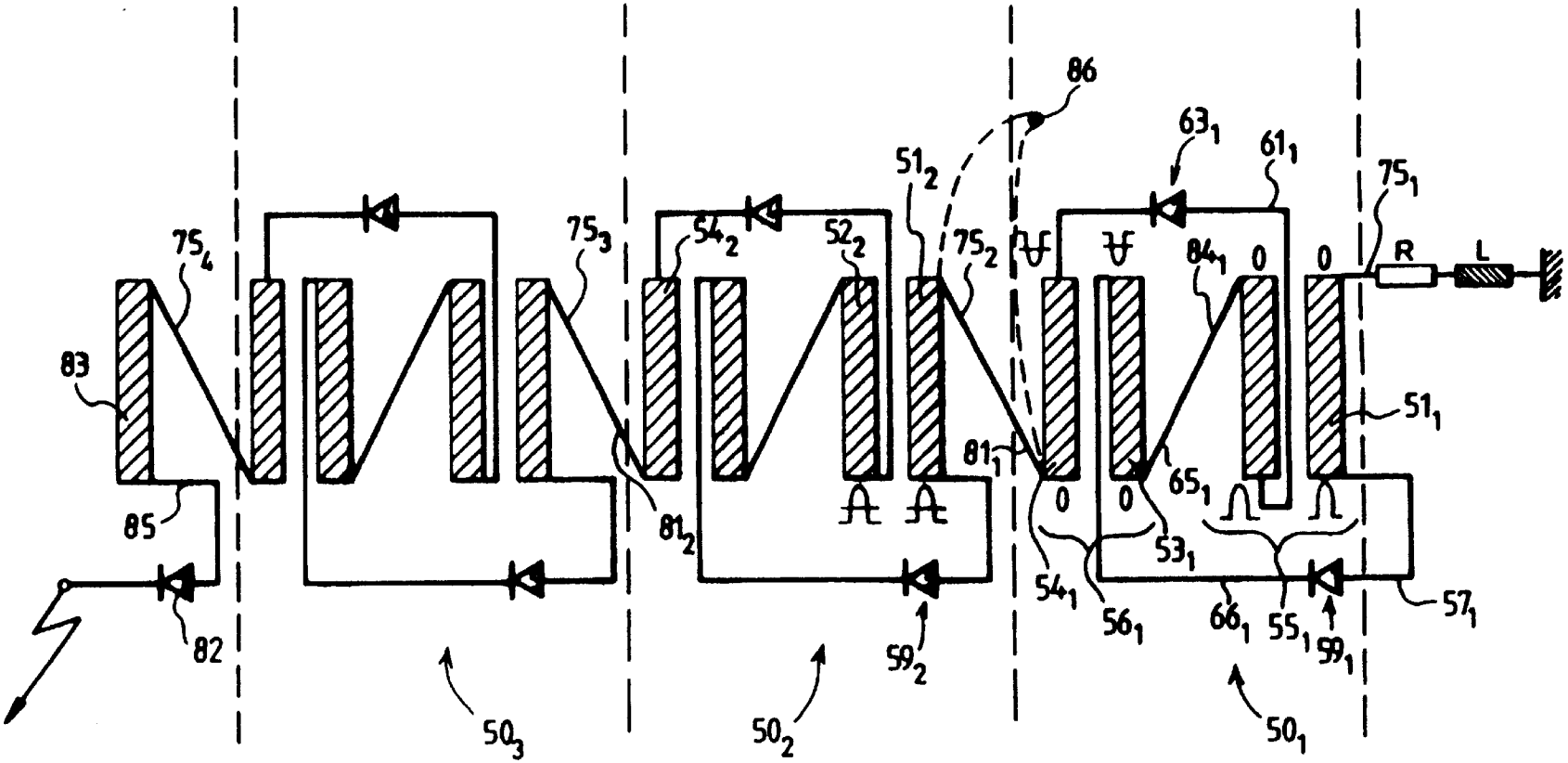
FIG. 6 diagrammatically represents the electrical links of the coil represented in FIG. 5.

A complete exemplary embodiment of a coil 100 of step-up windings will now be commented upon in conjunction with FIGS. 5 and 6. FIG. 5 represents a perspective view of a former 72 of the coil 100 and of the diodes and windings of this coil 100. This FIG. 5 is intended to elucidate the mechanical aspects of the invention as well as the manufacturing process. FIG. 6 is intended to depict the electrical connections of the step-up coil represented in FIG. 5. It will be seen in the course of the following description that the exemplary embodiment according to the invention comprises three elementary cells such as represented in FIG. 3. In describing these cells, in conjunction with FIGS. 5 and 6, the same numbering will be used as in FIG. 3. The elements having the same function as those represented in FIG. 3 will therefore have identical reference numerals accompanied by an index 1, 2, 3 . . . n, "n" representing the number of mutually similar elements, so as to distinguish them physically from one another. Likewise, the other mutually similar elements of FIG. 5 will have identical reference numerals accompanied by an index 1, 2, 3 . . . n. An unindexed reference numeral will be employed to denote an element generically. So as not to overload FIGS. 5 and 6, not all the indexed references will necessarily be shown in the figures.

The former 72 takes the known form of a hollow cylinder with axis AA'. In a known manner this axis is also the axis of a magnetic circuit (not represented). The outer part of the former 72 comprises 21 partitions $\mathbf{80}_1$ to $\mathbf{80}_{21}$ whose outer lateral surface has been indicated with a dot, so as to clarify the understanding of the drawing, since, although the drawing is on an enlarged scale, the succession of parallel lines representing the partitions and the grooves or chambers, intermediate between two partitions, is not easy to follow in FIG. 5. In order to create a convenient lexical distinction when explaining the invention, the volume included between the outer surface of the cylinder 72 and two consecutive partitions 80 is referred to as a groove or chamber according to the distinction explained hereinbelow. As already seen earlier, some of these volumes contain wire windings and others do not contain any. The term "groove" is employed when a volume between two consecutive partitions 80 delimiting this volume does not contain wire windings. When an intermediate volume between two consecutive partitions contains wire windings, the term chamber is employed. The wire windings have been represented by a thick black line in FIG. 5. Thus, two chambers are axially consecutive when they are not separated from one another by any chamber, whereas two axially consecutive chambers can be separated from one another by one or more grooves. The coil 100 represented thus comprises 12 partial windings grouped into three elementary cells $\mathbf{50}_1$ to $\mathbf{50}_3$ housed in 12 chambers $\mathbf{79}_1$ to $\mathbf{79}_{12}$. It also comprises an additional winding 83 and an additional diode 82. The intermediate grooves between two consecutive partitions have been marked by a small cross, again to facilitate the understanding of the figure. There are thus seven grooves 76to $\mathbf{76}_7$ containing no windings. These 7 grooves house passages for wires.

The structure of the coil 100 will now be explained by describing one possible mode of manufacture.

The former 72 is made in a known manner by moulding. The seven diodes are firstly installed on diode supports 73, 74 which preferably constitute part the moulded former 72. In FIG. 5 these supports are labelled $\mathbf{73}_1$ to $\mathbf{73}_7$ and $\mathbf{74}_1$ to $\mathbf{74}_7$. So as not to overload the figure, only the first and last elements are actually numbered. Advantageously, the supports 73, 74 protrude radially from the cylindrical former 72, at the grooves $\mathbf{76}_1$–$\mathbf{76}_7$, labelled in the figure with a cross. These grooves 76 do not contain windings as indicated earlier. As will be seen again later, these grooves 76 separate pairs of windings whose inter-winding capacitances $C_2$ (see FIG. 3) are not neutralized. Therefore, the axial length of these grooves serves a dual purpose: they contribute to decreasing the inter-winding capacitance $C_2$ and they house the foot of the supports 73, 74. The latter must have a sufficient thickness to house hollows for receiving the connections 77, 78 of the diodes 59, 63 or 82 whilst preserving sufficient sturdiness, doing so within a minimum bulk. The fact that the diodes are mounted before carrying out the coiling is an advantageous characteristic of the process for manufacturing a coil 100 according to the invention, since this makes it possible to use the connections 77, 78 of these diodes to fix the ends of the wires to be coiled, if necessary, for example by tight winding about these connections (wrapping), so as to make the step-up windings. Therefore it is possible to do away with the joining pins which are used in a known manner in the prior art and this contributes to the compactness of the transformer. The mode of coiling the wires making up the step-up windings will now be explained. A wire is wound on the anode connection $\mathbf{77}_1$ of the first diode $\mathbf{59}_1$ and the wire is coiled in the first chamber $\mathbf{79}_1$. The outer end $\mathbf{75}_1$ of this first winding 51 of the first pair of the first cell $\mathbf{50}_1$ is connected in a known manner to a source of constant potential for example and, as represented in FIG. 1 or 6, to earth by way of a resistor in parallel or in series with an inductor. Likewise, a wire is wound on the anode connection $\mathbf{77}_2$ of the second diode $\mathbf{63}_1$ and the is coiled in the second chamber $\mathbf{79}_2$. A pair of windings $\mathbf{55}_1$, as represented at 55 in FIG. 3, is thus obtained. The inter-winding capacitances $C_1$ of the chambers constituting a pair being inactivated, the windings of a pair are axially consecutive windings separated by a single partition $\mathbf{80}_3$. The outer end $\mathbf{84}_1$ of the winding $\mathbf{52}_1$ contained in the chamber $\mathbf{79}_2$ is then introduced into a guidance and retention slot (not represented) of the partition $\mathbf{80}_4$ thereby allowing it to be introduced into the empty groove $\mathbf{76}_2$. The wire merely passes through this groove and it is introduced into a guidance and retention slot (not represented) of the partition $\mathbf{80}_5$ thereby allowing it to be introduced into the bottom of the chamber $\mathbf{79}_3$ where it constitutes the winding $\mathbf{53}_1$. It may be noted that in this exemplary embodiment, the outer end $\mathbf{84}_1$ of the second winding $\mathbf{52}_1$ of the first pair $\mathbf{55}_1$ is in direct continuity with the inner end $\mathbf{65}_1$ of the first winding $\mathbf{53}_1$ of the second pair $\mathbf{56}_1$. Naturally the connection between an inner end and an outer end can also be ensured by means of a joining pin. After coiling the wire in this chamber $\mathbf{79}_3$, the outer end $\mathbf{66}_1$ of the winding $\mathbf{53}_1$ is connected to the cathode of the diode $\mathbf{59}_1$. A new wire is wound tightly on the anode $\mathbf{58}_2$ of the diode $\mathbf{59}_2$ and it is coiled inside the chamber $\mathbf{79}_5$ so as to constitute the winding $\mathbf{51}_2$. This winding $\mathbf{51}_2$ is the first winding of the first pair $\mathbf{55}_2$ of the second elementary cell $\mathbf{50}_2$. The outer end $\mathbf{75}_2$ of the winding $\mathbf{51}_2$ is guided by means of a slot (not represented) of the partition $\mathbf{80}_8$ towards the groove $\mathbf{76}_3$ which it passes through so as to meet up, via a slot (not represented) of the partition $\mathbf{80}_7$, with the chamber $\mathbf{79}_4$ where it is coiled so as to constitute the winding $\mathbf{54}_1$. The outer end of the winding $\mathbf{54}_1$ is connected to the cathode $\mathbf{64}_1$ of the diode $\mathbf{63}_1$. It may be noted that in this exemplary embodiment, the outer end $\mathbf{75}_2$ of the first winding $\mathbf{51}_2$ of the first pair $\mathbf{55}_2$ of an intermediate cell such as the cell $\mathbf{50}_2$ is in direct continuity with the inner end $\mathbf{81}_1$ of the second winding $\mathbf{54}_1$ of the second pair $\mathbf{56}_1$ of the preceding cell $\mathbf{50}_1$. This direct connection between an inner end and an outer end can also be ensured by means of a joining pin. This possibility is used at least once in a coil according to the invention in particular to obtain a connection carrying the focusing voltage. FIG. 6 represents this possibility by a dotted line. According to this embodiment represented by a dotted line, the outer end $\mathbf{75}_2$ of the first winding $\mathbf{51}_2$ of the first pair $\mathbf{55}_2$ of an intermediate cell such as the cell $\mathbf{50}_2$ is joined to a pin (86). Therefore, the inner end $\mathbf{81}_1$ of the second winding $\mathbf{54}_1$ of the second pair $\mathbf{56}_1$ of the preceding cell $\mathbf{50}_1$ is itself joined to this same pin 86 for the focus voltage output.

After executing the coiling operations just described, it may be observed that the four windings $\mathbf{51}_1$, $\mathbf{52}_1$, $\mathbf{53}_1$, $\mathbf{54}_1$ making up the first cell $\mathbf{50}_1$ are coiled. The same goes for the first pair $\mathbf{51}_2$ of the second cell. The coiling of the other windings $\mathbf{52}_2$, $\mathbf{53}_2$ and $\mathbf{54}_2$ of the second cell $\mathbf{50}_2$ as well as that of other intermediate coils, if the coil 100 comprises more than three elementary cells 50, is carried out in a similar manner. The coiling of the third cell, or more generally of the last cell, if the coil 100 comprises more than three elementary cells 50, is performed in the same manner, with the possible exception of the fourth winding $\mathbf{54}_3$ or more generally $\mathbf{54}_n$ of the last cell $\mathbf{50}_3$ or $\mathbf{50}_n$.

In the exemplary embodiment described above, the two pairs 55, 56 of windings which together make up a cell are housed in chambers 79 axially separated from one another by grooves 76, whilst the windings of a pair 55 or 56 are housed in consecutive chambers 79 having a common separating partition 80. Likewise, the fourth winding 54 of a cell 50 is housed in a chamber 79 which is axially separated from the chamber housing the first winding 51 of the following cell 50 by at least one groove 76. As seen earlier, the groove 76 separating two axially consecutive chambers 79 houses the feet of the diode supports 73, 74.

The mode of manufacturing the windings which has just been described, by describing a string of operations in a necessarily linear manner, should not be understood as signifying that these winding operations are performed in succession. The advantage indicated earlier of the possible simultaneity of windings of various chambers is preserved in the embodiment of the coil 100 according to the invention.

It will have been noted that the exemplary embodiment just described in relation to FIGS. 5 and 6 is based on the cell model 50 described in relation to FIG. 3. Naturally, it is equivalent from the point of view of the inactivation of inter-winding capacitances to use cells 50 according to the variants described in relation to FIGS. 3 and 4.

Thus a coil 100 constructed on the cell model 50 represented in FIG. 4 comprises at least two pairs of windings, a first (55) and a second (56), the four windings (51–54) constituting the two pairs (55, 56) being housed in consecutive chambers ($\mathbf{79}_1$, $\mathbf{79}_{12}$), the two pairs together making up an elementary cell (50), the outer end (75) of the first winding (51) of the first pair (55) being connected to the anode (58) of the first diode (59), the outer end (84) of the second winding (52) of the first pair (55) being connected to the anode (62) of the second diode (63), and the inner end (65) of the first winding (53) of the second pair (56) being connected to the cathode (60) of the first diode (59), the inner end (81) of the second winding (54) of the second pair (56) being connected to the cathode (64) of the second diode (63).

The inner end (61) of the second winding of the first pair (55) is connected to the outer end (66) of the first winding (53) of the second pair (56).

The joining of a preceding intermediate cell to a following intermediate cell or to the last cell is effected by the fact that the outer end ($\mathbf{67}_1$) of the second winding ($\mathbf{54}_1$) of the second pair ($\mathbf{56}_1$) of the preceding cell ($\mathbf{50}_1$) is connected to the inner end ($\mathbf{57}_2$) of the first winding ($\mathbf{51}_2$) of the following cell ($\mathbf{50}_2$).

Figure 7:
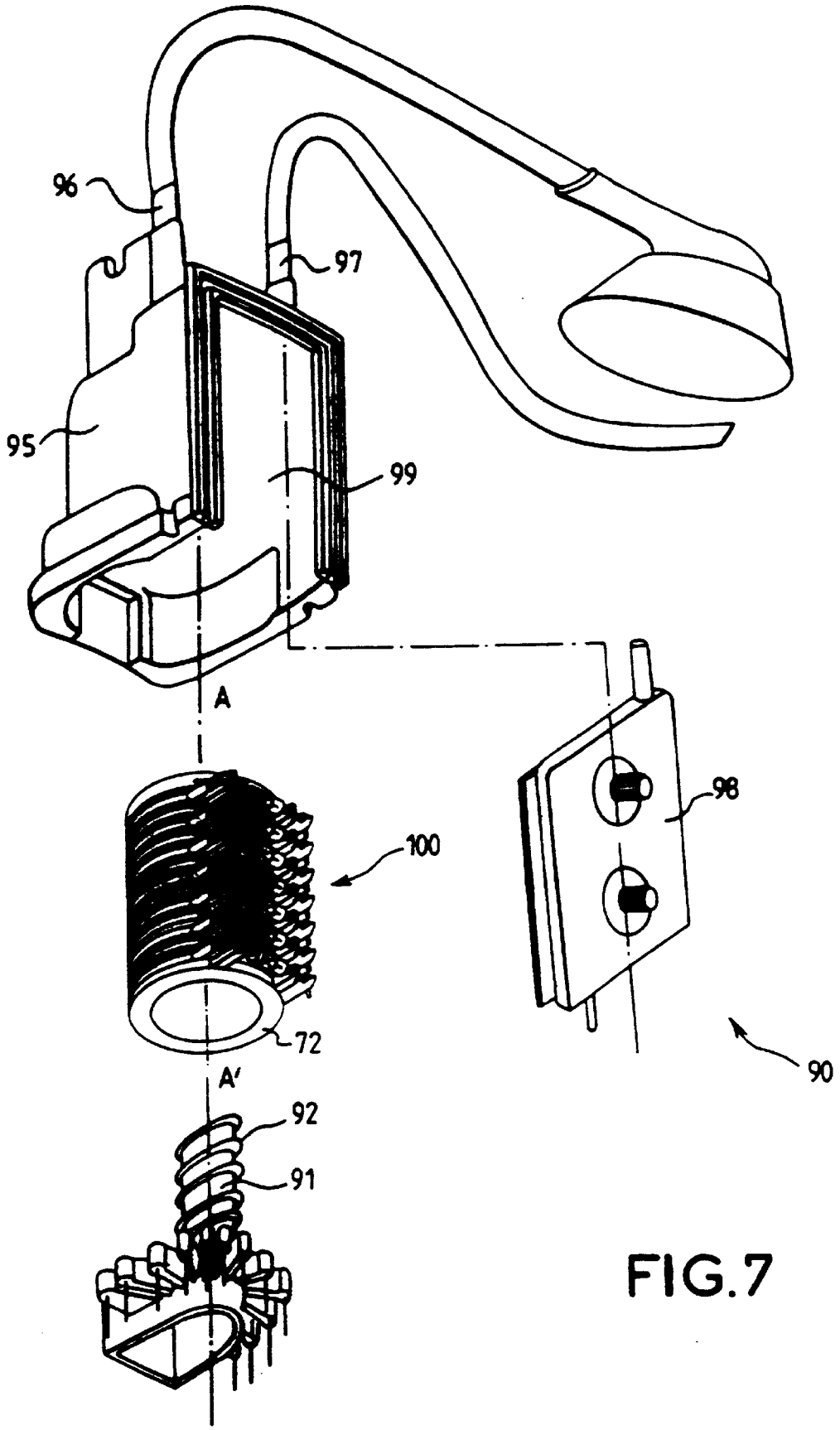
FIG. 7 represents a transformer equipped with a step-up coil comprising windings constructed according to the invention.

In a known manner, a coil 100 in accordance with one of the variant embodiments of the invention is included in a transformer 90 known per se and represented in an exploded view in FIG. 7. An example of such a transformer differs from a known transformer only in the fact that it includes this coil 100.

The high-voltage transformer 90 represented in FIG. 7 is intended for powering a cathode-ray tube (not represented). Around a core made of ferromagnetic material (not represented), it comprises a first coil former 91 carrying primary and secondary windings referenced 92 overall, and a second coil former 72 as described above. It is this second coil former which carries the high-voltage windings for powering the grids of the cathode-ray tube. The two coil formers 91 and 72 are in the mounted position, concentric with one another, the primary coil former 91 lying inside the tertiary coil former 72. The assembly of the two coils together with that part of the core around which the coils 91 and 72 are mounted is housed in a casing 95 made in general of an insulating plastic. This casing 95 comprises two output ducts for the high voltages referenced 96 and 97 respectively, a first output 96 for the anode high voltage and a second output 97 for the focusing high voltage. The latter is in general adjustable by means of a potentiometer block 98 mounted removably or otherwise on an open face 99 of the insulating casing 95.

There are embodiments (variants) in which the focus pin 86 energizes a potentiometer block from which there protrude not one but two output ducts for the focusing voltages, a static focus and a dynamic focus, as well as, very often, a voltage G2 for accelerating the electrons (around 1500 volts maximum).

What is claimed is:

1. Coil of a transformer, the coil comprising a coil former made of an insulating material, the former comprising chambers along an axial line of the former, these chambers, delimited by radial partitions housing voltage step-up wire windings including a first winding, a last winding, and intermediate windings, each of these windings having two ends, an inner end and an outer end, each end of said windings being, with the exception of one of the ends of the first winding and of one of the ends of the last winding, connected to an end of a following or preceding winding or to an electrode of a step-up diode having two electrodes, an anode and a cathode, said coil comprising at least one pair of windings, the pair including two windings, a first winding of the pair and a second winding of the pair, housed in two consecutive chambers, at least a first diode and a second diode, the inner end of the first winding of the pair being connected to an electrode of the first diode, the inner end of the second winding of the pair being connected to the electrode of the second diode having a polarity the same as the electrode of the first diode connected to the inner end of the first winding.

2. Coil according to claim 1, wherein said coil comprises at least two pairs of windings, a first pair and a second pair, thereby defining four windings being housed in consecutive chambers, the two pairs together making up an elementary cell, the inner end of the first winding of the first pair being connected to the anode of the first diode, the inner end of the second winding of the first pair being connected to the anode of the second diode, and the outer end of the first winding of the second pair being connected to the cathode of the first diode, the outer end of the second winding of the second pair being connected to the cathode of the second diode.

3. Coil according to claim 1, wherein said coil comprises at least two pairs of windings, a first pair and a second pair, thereby defining four windings being housed in consecutive chambers, the two pairs together making up an elementary cell, the outer end of the first winding of the first pair being connected to the anode of the first diode, the outer end of the second winding of the first pair being connected to the anode of the second diode, and the inner end of the first winding of the second pair being connected to the cathode of the first diode, the inner end of the second winding of the second pair being connected to the cathode of the second diode.

4. Coil according to claim 2, wherein the outer end of the second winding of the first pair is connected to the inner end of the first winding of the second pair.

5. Coil according to claim 3, wherein the inner end of the second winding of the first pair is connected to the outer end of the first winding of the second pair.

6. Coil according to claim 4, wherein said coil comprises several elementary cells, a first cell, and a last cell, the inner end of the second winding of the second pair of a preceding cell being connected to the outer end of the first winding of a following cell.

7. Coil according to claim 5, wherein said coil comprises several elementary cells, a first cell, and a last cell, the outer end of the second winding of the second pair of a preceding cell being connected to the inner end of the first winding of a following cell.

8. Coil according to claim 6, wherein said coil comprises three elementary cells, a first cell, a second cell, and a third cell, the outer end of the first winding of the first cell being coupled to a source of constant potential, the inner ends of the second winding of the second pair of the first and second cells being connected respectively to the upper ends of the first windings of the first pair of the second and third cells, the inner end of the second winding of the second pair of the third cell being connected to an upper end of an additional winding, the lower end of this additional winding being connected to an output diode.

9. Coil according to claim 8, wherein the inner end of the second winding of the first cell is connected to the upper end of the first winding of the first pair of the second cell by way of a joining pin, this pin being itself connected to an output of the coil.

10. Coil according to claim 1, wherein the two windings of at least one pair of windings are housed in consecutive chambers having a common separating partition.

11. Coil according to claim 2, wherein a pair of windings of a cell is separated from the other pair of windings of the same cell by a groove, wherefrom protrude radially diode supports whereon are mounted diodes.

12. Coil according to claim 6, wherein a preceding cell is separated from a following cell by a groove, wherefrom protrude radially diode supports whereon are mounted diodes.

13. Coil according to claim 1, wherein ends of windings are connected directly to connections of diodes.

14. High-voltage transformer comprising a coil according to claim 1.

15. Coil of a transformer, the coil comprising a coil former made of an insulating material, the former comprising chambers along an axial line of the former, these chambers, delimited by radial partitions housing voltage step-up wire windings including a first winding, a last winding, and intermediate windings, each of these windings having two ends, an inner end and an outer end, each end of said windings being, with the exception of one of the ends of the first winding and of one of the ends of the last winding, connected to an end of a following or preceding winding or to an electrode of a step-up diode having two electrodes, an anode and a cathode, said coil comprising at least one pair of windings, including two windings, a first winding of the pair and a second winding of the pair, housed in two consecutive chambers, at least two diodes, a first and a second, the outer end of the first winding of the pair being connected to an electrode of the first diode, the outer end of the second winding of the pair being connected to the electrode of the second diode having a polarity the same as the electrode of the first diode connected to the inner end of the first winding.

16. Transformer with a coil comprising:

a coil former made of an insulating material and comprising at least a first chamber, a second chamber and a third chamber along an axial line of the former;

a first winding housed in the first chamber;

a second winding housed in the second chamber;

a third winding housed in the third chamber;

a first diode and a second diode;

wherein the first winding is connected between the first diode and the second winding, wherein the second diode is connected between the second winding and the third winding, wherein the first chamber and the third chamber are consecutive, wherein an electrode of a first polarity of the first diode connects the first winding at a given first end, and wherein an electrode of the first polarity of the second diode connects the first end of the third winding.

* * * * *